United States Patent [19]

d'Agnolo

[11] 4,174,799

[45] Nov. 20, 1979

[54] SYSTEM FOR THE TEMPORARY STORAGE OF YARN

[75] Inventor: Armando d'Agnolo, Porcia, Italy

[73] Assignee: Officine Savio S.p.A., Pordenone, Italy

[21] Appl. No.: 812,388

[22] Filed: Jul. 1, 1977

Related U.S. Application Data

[63] Continuation of Ser. No. 716,558, Aug. 23, 1976.

[30] Foreign Application Priority Data

Aug. 28, 1975 [IT] Italy ..... 83431 A/75

[51] Int. Cl.[2] ..... B65H 23/22

[52] U.S. Cl. ..... 226/7; 226/42; 226/95; 226/118

[58] Field of Search ..... 226/7, 95, 118, 108, 226/112, 42, 43, 97; 28/100, 101, 102

[56] References Cited

U.S. PATENT DOCUMENTS

| | | | |
|---|---|---|---|
| 3,112,054 | 11/1963 | Fleissner | 226/95 |
| 3,448,499 | 6/1969 | Czernin | 226/95 X |
| 3,638,279 | 2/1972 | Swados | 226/108 X |
| 3,739,967 | 6/1973 | Jones | 226/7 |
| 3,900,302 | 8/1975 | Langlois | 226/95 X |
| 3,907,187 | 9/1975 | Collausig | 226/95 X |

FOREIGN PATENT DOCUMENTS

| | | | |
|---|---|---|---|
| 1243035 | 4/1959 | France | 226/108 |

*Primary Examiner*—Richard A. Schacher
*Attorney, Agent, or Firm*—Stevens, Davis, Miller & Mosher

[57] ABSTRACT

A system for the temporary storage of yarn comprising two oppositely rotatable vacuum drums, supply rollers for supplying yarn to the first of the drums, withdrawal rollers for removing yarn from the second drum and elements to read the size of the stock of yarn on the second drum and control the supply rollers, drums and withdrawal rollers. The second drum receives the yarn from the first drum in a manner to turn it over during transfer.

2 Claims, 4 Drawing Figures

FIG. 1
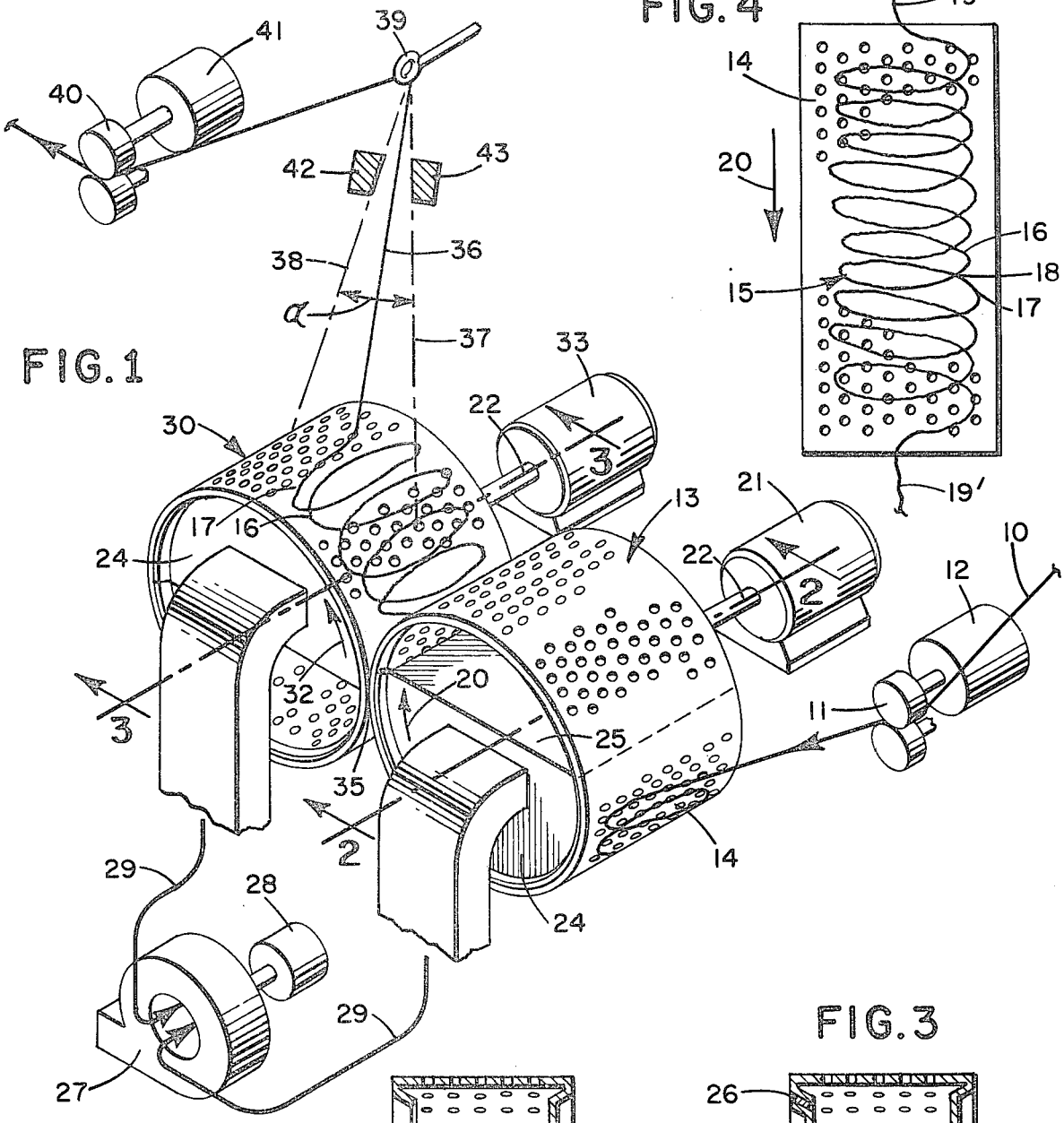
FIG. 4
FIG. 2
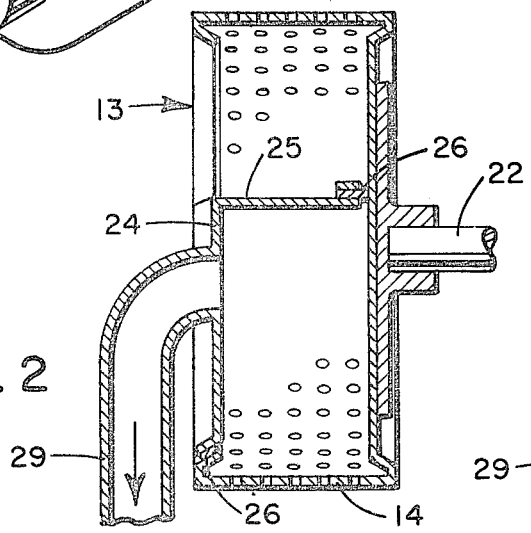
FIG. 3
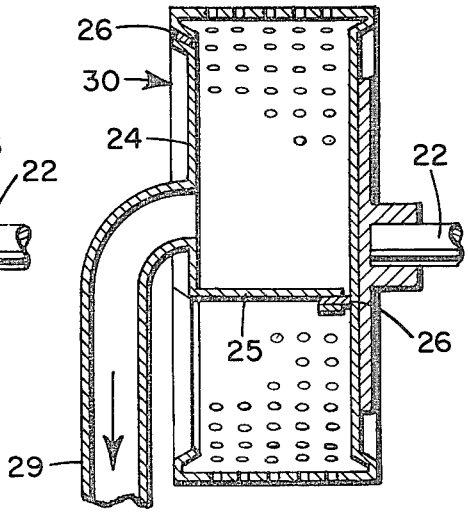

SYSTEM FOR THE TEMPORARY STORAGE OF YARN

This is a continuation of application Ser. No. 716,558 filed Aug. 23, 1976.

This invention relates to improvements in suction devices for the storage of yarn and, in particular, to rotating vacuum drums, which allow the reversal of the order of laying up yarn arriving on the storage drums. That is to say, the drums permit the underneath deposited layers to be brought to the surace and vice-versa.

Vacuum drums are known which consist of a hollow drum having holes drilled in it, the vacuum being produced inside the drum. The employment of such drums in some operations to process yarn is known, the yarn being natural or synthetic. In such operations the drum is set in rotation and an accumulation of yarn is applied thereto to act as a regulating and storage means between a source of supply and a usage means.

In accordance with operations of this nature the yarn is deposited on the rotating vacuum drum at one position and is withdrawn from it at another position. The size of the stock of yarn thereon is continuously examined so that action can be taken in a kinematic and coordinated manner to regulate the supplying source, the usage means and the drum itself.

The yarn arriving from the source is laid up on the drum, and this leads to various difficulties when it is withdrawn therefrom.

These difficulties make themselves felt most when the yarn is fine and of small bulk, since, with the traditional methods, the withdrawal is carried out by removing the lowest layer which was the first to be deposited.

A first difficulty is that the yarn, of which the lowest layer is withdrawn first, becomes entangled owing to the layer on top of the lowest being overturned onto other layers. This leads to the formation of knots or heaps of yarn which could cause breakage of the yarn itself during the subsequent phases.

A second difficulty is the formation, again during withdrawal of the yarn, of loops which lead to interruptions of the kind mentioned above.

The last difficulty is the formation of spirals owing to the overturning of the layers induced by the withdrawal system. In a similar manner to the loops and tangles, the spirals lead to breakage of the yarn in the subsequent operations.

These difficulties are not fully overcome, especially so if the yarn is fine and of small bulk, even by using devices of a tubular type for accumulating the yarn, where the yarn is deposited at one position and withdrawn from another position.

In this last situation, where the yarn is superimposed and not withheld on the tube, it happens that more than one coil will come off at a time during withdrawal, particularly so if the yarn is fine and of small bulk. This will lead to the known difficulties with spirals, loops and tangles.

The device which is the subject of the present invention provides a pair of hollow drums with holes drilled in them, a suction action being exerted through the holes. The pair of hollow drums with holes enables the yarn to be withdrawn without the formation of tangles, loops and spirals and at the same time acts as a storage means for the yarn. All of this takes place not only without the difficulties mentioned above but with further new advantages.

A first advantage lies in the fact that by reading the extent of the stock of yarn existing on the withdrawal drum it is possible to obtain signals with which the speed of supply and withdrawal can be controlled together with the speed of rotation of the drums themselves.

Another advantage is that it is possible to apply a suitable adjustment to the relative speeds of the drums so as to facilitate withdrawal with a view to avoiding tangles, spirals, loops and twists and to preventing the yarn from falling.

These advantages together with further new useful features and advantages that will appear hereinafter are pursued by this invention by means of suction devices provided with supply means and unwinding means that cooperate therewith and are characterized by comprising in reciprocal combination and coordination a yarn supply means, a yarn unwinding means, a first rotating vacuum drum that receives the yarn from the supply means and a second vacuum drum which is parallel to the first drum and rotates in the opposite direction therefrom, receiving the yarn from the first drum and having the yarn withdrawn therefrom by the unwinding means and means for reading the size of the stock of yarn on the second drum and controlling the supply means, unwinding means and rotating drums.

The above and other features and advantages of the present invention will become more readily apparent from the following non-limiting detailed description, reference being made to the drawings in which:

FIG. 1 shows a device in accordance with the invention;

FIG. 2 shows a vertical section of the first drum along the line II—II of FIG. 1;

FIG. 3 shows a vertical section of the second drum along the line III—III of FIG. 1; and FIG. 4 shows the development of the surface exerting suction on the first drum bearing the arm.

In the Figures the same parts or parts performing the same functions bear the same reference numbers.

With reference to FIGS. 1–4, 10 is the yarn arriving from any delivery source, being fed, for example, by supply rollers 11 turned by the motor 12. Drum 13 is the drum, on whose lower surface 14, suction is applied. Yarn 10 is deposited substantially in layers, loops and curls, thus forming the store 15 in which the loops 16 include points 18 superimposed on the preceding loops 17. Yarn 10 enters the store 15 at 19 and leaves at 19'. The drum 13 rotates in the direction 20 by means of motor 21 connected to shaft 22 of drum 13. Suction chamber 23 is positioned in drum 13 and is connected to casing 24. Chamber 23 encloses a portion slightly greater than half of drum 13. Casing 24 is limited at the center of drum 13 by plate 25, and an airtight seal is obtained with felts 26 which slide on drum 13. Fan 27 is activated by motor 28 and provides suction along conduit 29. Drum 30 with holes is the drum, on whose surface 31 the yarn arriving from first drum 13 is deposited and turns over, thus composing the stock of yarn 10 and including the loops 17 and 16 turned upside down. Drum 30 rotates in direction 32, opposite to that of drum 13. Motor means 33 rotates drum 30 by means of shaft 22. Vacuum chamber 34 is connected to casing 24. Area 35 is the location between drums 13 and 30 where the yarn is transferred and is the smallest gap between the drums. It is the area between the opposing edges of plates 25 of casings 24 of the drums. Yarn 10 is generically withdrawn at position 36 with positions 37 and 38 being the limiting positions corresponding respectively with the minimum and maximum stock and forming the angle $\alpha$. Yarn 10 passes through loop 39 reaching unwinding rollers 40, which are turned by motor 41. Elements 42 and 43 are the means that read the size of the stock of yarn 10 and may consist of blocks of piezoelectric material that cooperate, by means of ceramic bars, with the limit positions 37 and 38 of the yarn being withdrawn. The blocks provide a control signal. The piezoelectric means could be replaced with optical means e.g. a luminous ray (photoelectric cell), pneumatic means (air jet), electrical means (microswitches) or combinations thereof.

The system operates as follows. The yarn arrives from any delivery source, which for example could consist of supply rollers 11, and is deposited on suction surface 14 of drum 13 in frequent layers substantially superimposed on each other. The yarn adheres to the surface owing to the vacuum created in the chamber 23 by suction means 27.

Drum 13 is turned by motor 22 in a counterclockwise direction 20 and draws the yarn deposited on its downwards. The stock of yarn 15 thus forms on the surface, and successive loops 16 are superimposed on the preceding loops 17. If the yarn were to be withdrawn at 19' under these conditions, the preceding loops 17 would be underneath the successive loops 16 since the latter have been placed on top of the former at the points 18. If it is desired to withdraw the yarn at 19' without producing entanglements, it is necessary to turn the loops upside down so that the preceding ones are placed on top of the successive ones. This is brought about by drum 30, which is rotated in the direction 32 opposite to direction 20 by motor means 33. The yarn 10 reaches area 35 and is transferred from drum 13 to drum 30, resting its upper, outer side on drum 30 and showing that side which was previously resting on drum 13. Drum 30 rotates at a peripheral speed substantially the same as that of drum 13, thus continuing the forward and upward movement of stock 15. This is made possible by the absence of a vacuum in that part of drum 13 that is above area 35 and by the presence of a vacuum in that part of drum 30 that coincides with area 35 and the zone thereabove.

Having been transferred to drum 30 yarn 10 constitutes stock, which is drawn off by unwinding rollers 40, generally occupying withdrawal position 36 and passing through loop 39. During withdrawal of the yarn the stock is kept under examination by reading means 42 and 43, which allow the withdrawal position 36 to move through the angle $\alpha$ between the minimum 37 and maximum 38 positions.

When the stock goes below a minimum value pre-set by the position of scanning means 43, the yarn affects the scanner, which generates a signal and acts in a coordinated manner on motors 12, 21, 33 and 41 so as to build up the stock again. On the contrary when the stock exceeds a maximum value pre-set by the position of scanning means 42, the yarn being withdrawn affects the scanning means, which generates a signal and acts in a coordinated manner on the motors 12, 21, 33 and 41 to bring the stock of yarn 10 back to the pre-set values.

There has been described a preferential realization of the invention, but variants can be applied by a technician in this field without leaving the scope and spirit of the invention idea. Thus it is possible to change the shape and sizes of the individual parts and also to reverse the directions of rotation of the two drums and consequently to invert the suction areas. It is possible for the whole surface of the second drum to exert suction. It is possible that the first drum too should have its whole surface exerting suction provided that the surface is smaller than that of the second cylinder so as to permit the transfer of the yarn.

It also is possible to adjust the distance between the two drums at the area 35 to suit the force of suction and the size of the yarn. It is possible to make the two drums rotate at different peripheral speeds so as to thin out the yarn on the second drum. It also is possible to link one drum rigidly to the other with a coupling of the cogwheel or belts/pulleys type.

Furthermore it is possible to employ only one motor instead of the motors 12, 21, 33 and 41. In this case the supply rollers 11, unwinding rollers 40 and drums 13 and 30 would be connected to each other kinematically, for instance, by means of cog-wheels.

These and further variants are possible for a technician in this field without departing thereby from the scope of the invention idea.

What is claimed is:

1. A process for temporarily storing random continuous yarns in a relaxed state in which inversion of the yarn takes place comprising randomly laying up yarn on a first moving partitioned perforated drum, bringing a second partitioned perforated drum into close proximity with said first drum but spaced therefrom, transferring said randomly laid up yarn upwardly from said first drum to said second drum in inverted form where said drums are in close proximity, removing said yarn from said second drum and monitoring the yarn on said second drum thereby to regulate the supply of yarn to said first drum as well as its removal from said second drum.

2. The process of claim 1, whereby said yarn is maintained on said first and second drums by application of a vacuum on a side of said drum opposite to said yarn, said vacuum being prevented from being applied to said first drum when in close proximity to said second drum.

* * * * *